US007243478B2

(12) United States Patent
Dawson et al.

(10) Patent No.: US 7,243,478 B2
(45) Date of Patent: Jul. 17, 2007

(54) VACUUM SYSTEM MANIFOLD AND RELATED METHODS

(75) Inventors: Richard F. Dawson, Clinton, LA (US); Charles G. Walker, Baton Rouge, LA (US)

(73) Assignee: Walker-Dawson Interests, Inc., Clinton, LA (US)

( * ) Notice: Subject to any disclaimer, the term of this patent is extended or adjusted under 35 U.S.C. 154(b) by 121 days.

(21) Appl. No.: 11/099,193

(22) Filed: Apr. 4, 2005

(65) Prior Publication Data

US 2006/0218882 A1 Oct. 5, 2006

(51) Int. Cl.
*B65B 31/02* (2006.01)

(52) U.S. Cl. ..... 53/434; 53/459; 53/512; 53/570; 141/10; 141/65; 141/114; 141/313

(58) Field of Classification Search ..... 53/432, 53/434, 459, 510, 512, 570; 141/10, 65–68, 141/114, 313

See application file for complete search history.

(56) References Cited

U.S. PATENT DOCUMENTS 3,255,959 A * 6/1966 Smith ..... 141/67
3,323,559 A * 6/1967 Sturges ..... 141/10
4,219,054 A * 8/1980 Carter et al. ..... 141/10
4,307,486 A 12/1981 Matsumoto
4,581,764 A 4/1986 Plock et al.
5,183,086 A 2/1993 Fanta et al.
5,302,029 A 4/1994 Weber et al.
5,350,239 A 9/1994 Strand et al.
5,402,918 A * 4/1995 Nishiyama et al. ..... 222/152
5,682,929 A * 11/1997 Maginot et al. ..... 141/65
5,779,894 A 7/1998 Martensson
6,322,327 B1 11/2001 Dawson et al.
6,332,564 B2 12/2001 Ichikawa
6,374,579 B1 4/2002 Muller
6,450,775 B1 9/2002 Hutchinson et al.
6,899,147 B2 * 5/2005 Ogawa et al. ..... 141/114

FOREIGN PATENT DOCUMENTS

JP 03176303 A * 7/1991

* cited by examiner

*Primary Examiner*—Stephen F. Gerrity
(74) *Attorney, Agent, or Firm*—Sieberth & Patty, LLC

(57) ABSTRACT

A system which provides a first object defining a first volume and a second object defining a second volume wherein the second object contains the first object. A manifold apparatus is provided which allows a flowable material to flow by vacuum action into the first object and also allows any entrained gas to be transported from the first volume to the second volume without interrupting the vacuum. Methods of use of the system and structures for detachably attaching the manifold apparatus are also provided.

16 Claims, 5 Drawing Sheets

VACUUM SYSTEM MANIFOLD AND RELATED METHODS

TECHNICAL FIELD

This invention relates to systems for providing vacuum in confined spaces and more particularly to devices and methods for directing and controlling a vacuum in confined spaces.

BACKGROUND

The industry concerned with movement of slurried material in bulk quantities makes use of various types and styles of transportation and storage devices and containers, such as, roll-off boxes and vacuum containers. Of paramount concern is the efficiency of loading and unloading the slurried material with the lowest degree of operator involvement. The force used to move the slurried material into a container has been provided by numerous types of mechanical and vacuum systems. Conventional vacuum systems present special obstacles to efficient operation. Many times the vacuum container or roll-off box is constructed so that provision of an air-tight seal is impractical if not impossible. In those instances, it is useful to provide a liner for the vacuum container which can provide an air-tight volume of space. During loading operations, it is possible that gases such as air can be forced into the container along with the material to be loaded. This might happen, for example, when the terminal end of an input hose is lifted out of the material to be loaded. This action would bring unwanted air into the liner volume along with the desired material. Depending on the characteristics of the vacuum container and liner, this air can occupy enough space or exert enough vapor pressure within the volume containing the material that loading operations are adversely impacted.

A need exists for a vacuum system for moving a free-flowing material, such as a slurried material, into a container for transport or storage with a minimum degree of user interaction and in an efficient manner so that the negative effects of unwanted entrained gases is minimized or eliminated. A need exists for a way to allow the operator to deflate a volume containing loaded material or remove gas from the volume at will without interrupting the application of the vacuum. A further need exists for a way to attach the vacuum container and vacuum container liner to the source of material to be moved so as provide efficient loading operations.

SUMMARY OF THE INVENTION

In addressing one or more of these needs, amongst others, one embodiment of the present invention provides a manifold system which allows the operator to use a manifold apparatus to divert the direction of fluid flow within an established fluid communication pathway so that any entrapped gases within the volume holding the moved material can be eliminated without shutting down the system.

Another embodiment of the invention provides a novel manifold apparatus which is easily attached to conventional flanged openings such as those typically found on large-scale storage containers and vacuum containers.

Yet another embodiment of the invention provides a system comprising (A) a first object defining a first volume; (B) a second object defining a second volume, which second object contains the first object; and (C) a manifold apparatus.

The manifold apparatus in this embodiment comprises: (I) a first flow controller; (II) a second flow controller; (III) a primary fluid conduit through which a flow of flowable material may be controlled by the first flow controller, the primary conduit being in fluid communication with the first volume and with a source of flowable material; (IV) a secondary fluid conduit through which a flow of gas may be controlled by the second flow controller; and (V) a housing surrounding at least a portion of the primary conduit, which housing defines a housing volume, which housing volume is in fluid communication with the second volume and with the secondary fluid conduit. The flowable material may flow from the source of flowable material to the first volume through the primary fluid conduit upon sufficient application of a first motive force when the first flow controller is in an open condition and the second flow controller is in a closed condition. A gas may be transported from the first volume to the second volume by passing through the primary fluid conduit, the secondary fluid conduit and the housing volume, upon sufficient application of a second motive force when the first flow controller is in a closed condition and the second flow controller is in an open condition.

Another embodiment of the invention provides that the housing is detachably attached to the second object by a hinging structure and to a material conduit for transporting the material from the source of flowable material. The hinging structure comprises (a) a first plate member which forms a surface. The first plate member surface forms at least one projecting pin and defines at least one plate aperture. The hinging structure also comprises (b) a second plate member which is rotationally joined to the first plate member and which second plate member is attached to the housing; and (c) at least one bolt. The projecting pin is sized and configured to be received by a first flange aperture of two or more flange apertures defined by a flange member of the second object. The bolt is sized and configured to be received by the plate aperture and by a second flange aperture, such that when the first and second flange apertures receive the projecting pin and the bolt, the first plate member and the second plate member may rotate into substantially flush position relative to one another.

Another preferred embodiment of the invention provides a method for loading a flowable material into a first object which first object is contained by a second object. The method comprises:

(A) attaching a manifold apparatus to a first object portal and to a second object portal, which apparatus comprises:
  (I) a primary fluid conduit through which flow of the flowable material may be controlled by a first flow controller and which primary fluid conduit is in fluid communication with a first volume defined by the first object;
  (II) a secondary fluid conduit through which flow of a gas from the first volume may be controlled by a second flow controller; and
  (III) a housing surrounding at least a portion of the primary fluid conduit, which housing is in fluid communication with the secondary fluid conduit and with a second volume defined by the second object which second volume is discrete from the first volume;
(B) placing a second portion of the primary fluid conduit into fluid communication with a source of flowable material;
(C) opening the first flow controller and closing the second flow controller so that the flowable material can move from the source of flowable material into the first volume;
(D) creating a vacuum in the second volume, such that pressure of the second volume is less than pressure of the first volume thereby causing the flowable material to move from the source of flowable material, through the primary fluid conduit and into the first volume;

(E) removing substantially all of the gas from the first volume by (i) closing the first flow controller thereby interrupting movement of the flowable material into the primary fluid conduit, (ii) opening the second flow controller to place the first volume in fluid communication with the secondary fluid conduit, with the housing, and with the second volume thereby causing the gas to move from the first volume to the second volume, (iii) closing the second flow controller, and optionally (iv) opening the first flow controller to thereby re-establish movement the material into the first volume; and (F) repeating (E) one or more times.

These and other embodiments, features, and advantages of this invention will be become still further apparent from the ensuing description, appended claims and accompanying drawings.

SUMMARY OF THE DRAWINGS

In each of the above figures, like numerals are used to refer to like or functionally like parts among the several figures.

DETAILED DESCRIPTION OF THE INVENTION

It will now be appreciated that this system has, among others, the desirable feature of providing a manifold apparatus which is easily attachable to a conventional vacuum container and which can be configured to permit vacuum-loading of a flowable material into a volume and drawing off undesirable gas or gases from the volume. Both loading and draw-off operations can be accomplished without interrupting the application of a vacuum to the system. Such flowable material can comprise a fluid, a slurry of at least one liquid and at least one solid, at least one particulate solid capable of fluid-like flow, or any two or more of the foregoing.

Figure 1A:
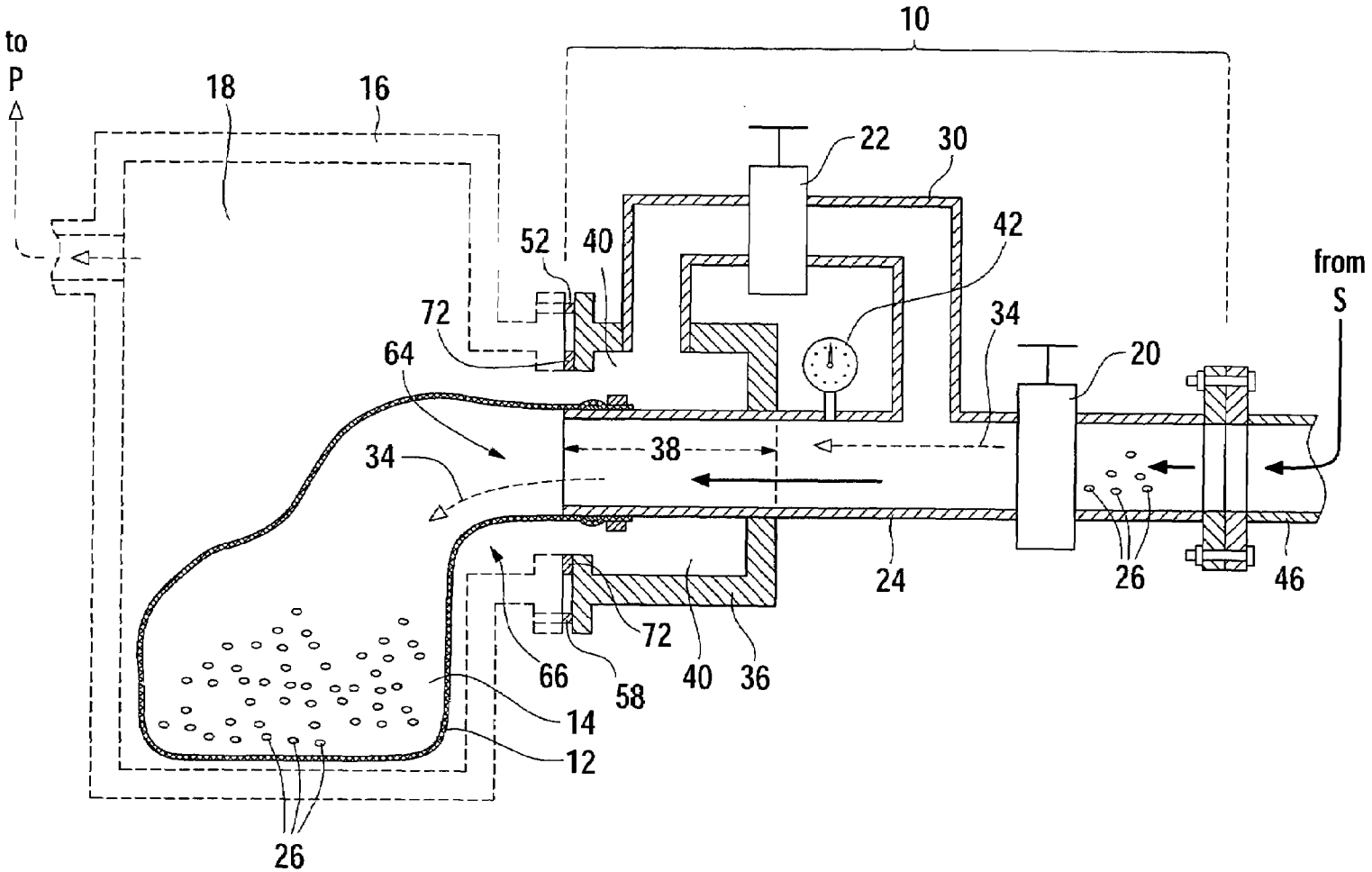
FIG. 1A is a cross-sectional side view of an embodiment of the invention.

Turning now to the drawings, FIG. 1A illustrates, in cross-section, a system for providing a vacuum as a motive force to load a flowable material 26 into a first object, shown in this preferred embodiment of the invention, as a bulk bag 12 formed from a fluid impermeable substance, which bag 12 defines a first volume 14. Bag 12 is contained by a second object, depicted in this preferred embodiment of the invention as a vacuum container 16 which vacuum container 16 defines a second volume 18. Second volume 18 is in fluid communication with a vacuum pump P which provides at least one motive force for causing flowable material 26 to move into first volume 14 of bag 12. During operation of vacuum pump P, a vacuum is created within vacuum container 16 to thereby cause bag 12, which was in an initial deflated state, to expand as shown, and form a vacuum in vacuum container 16 and second volume 18 to draw flowable material 26 (typically at atmospheric pressure or at least at a pressure higher than that in second volume 18) through a manifold apparatus 10 and into bag 12 to occupy empty first volume 14. Bag 12 comprises a first object portal 64 which is attached to a primary fluid conduit 24 at a portion of primary fluid conduit 38 by conventional means such as ring and clasp. During typical operation of the system, unwanted gases such as, but not limited to, air 34 can be transported with flowable material 26 into bag 12.

Figure 1B:
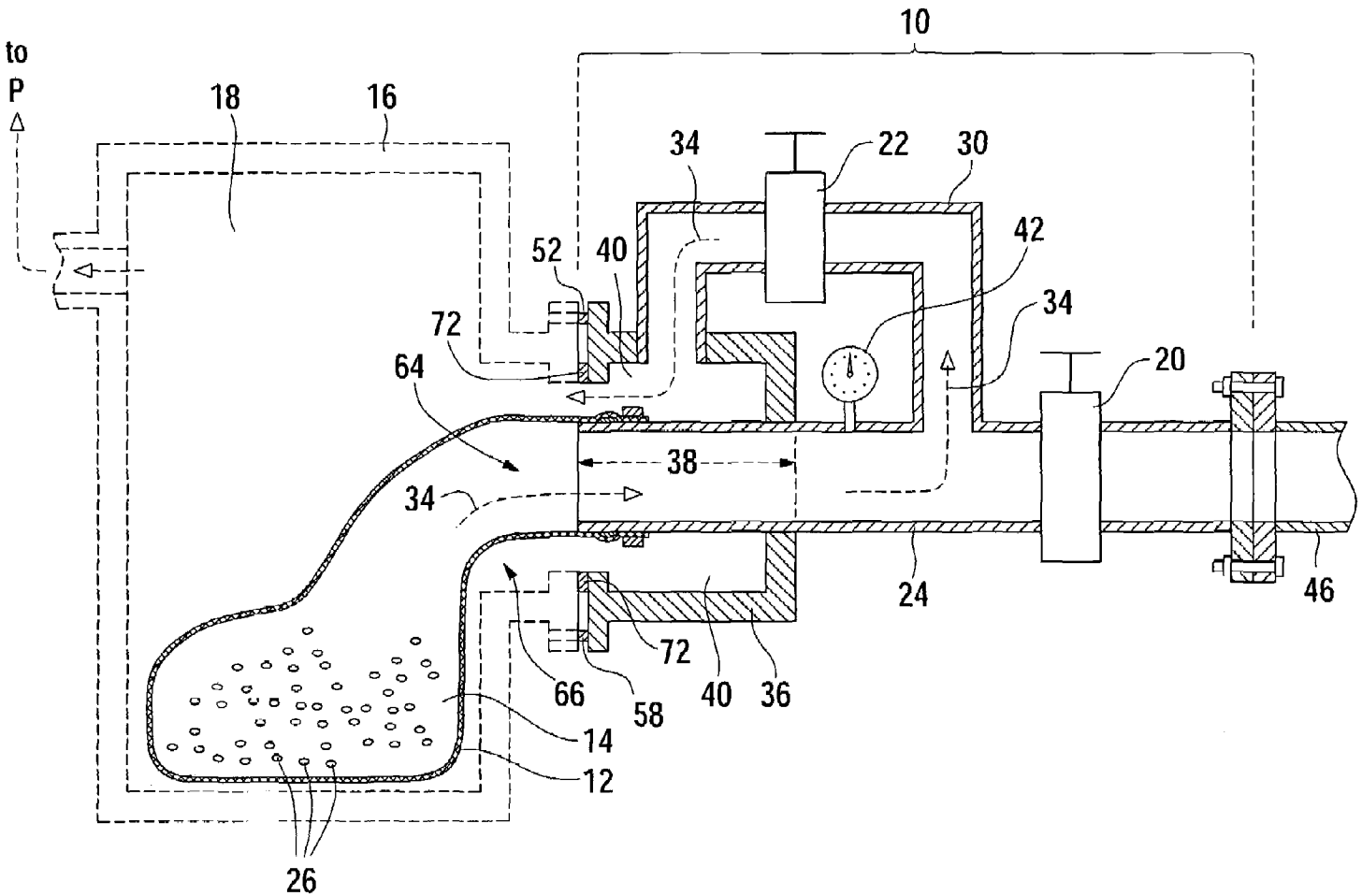
FIG. 1B is an embodiment of the invention of FIG. 1A, showing an alternate flow path of materials.

As seen in FIGS. 1A and 1B, manifold apparatus 10 comprises a first flow controller 20 which controls the flow of flowable material 26 from a source of flowable material S, though primary fluid conduit 24. Primary fluid conduit 24 is in fluid communication with first volume 14 and with source flowable material S. Apparatus 10 also comprises a secondary fluid conduit 30 through which a flow of gas 34 may be controlled by a second flow controller 22. Secondary fluid conduit 30 is in fluid communication with first volume 14 and with a housing volume 40, defined by a housing 36 of apparatus 10. Housing 36 surrounds a portion of primary fluid conduit 38 proximate to a point of attachment of bag 12 to primary fluid conduit 24 to define housing volume 40.

A preferred embodiment of the invention, as depicted in FIG. 1A, is configured so that flowable material 26 may flow from source of the flowable material S to first volume 14 through primary fluid conduit 24 upon sufficient application of a first motive force when first flow controller 20 is in an open condition and second flow controller 22 is in a closed condition.

Another preferred embodiment of the invention as illustrated in FIG. 1B, shows manifold apparatus 10 configured to allow gas 34 to be transported from first volume 14 to second volume 18. Gas 34 passes through primary fluid conduit 24, secondary fluid conduit 30 and housing volume 40 upon sufficient application of a second motive force. First flow controller 20 is in a closed condition an second flow controller 22 is in an open condition to permit this removal of unwanted gas, such as, but not limited to, air, from bag 12.

In a particularly preferred embodiment of the invention, the first motive force and the second motive force are both provided by a vacuum created in second volume 18 by a vacuum pump and more particularly preferred, by a jet pump. Vacuum gauge 42 aligned with primary fluid conduit 24 provides ability to monitor pressure within the system.

By providing the manifold apparatus of this invention, the operation of removal of gas from a partially filled or substantially filled bag can be carried out quickly and simply with a minimum of user interaction with the equipment. There is no need for the user to shut down the vacuum pump in order to accomplish "burping" the bag to remove unwanted gas which may have entered the bag with the flowable material. With easy access to the first and second controllers, the user can adjust the controllers to quickly stop the flow of flowable material (including any entrained gas), remove the unwanted gas from the bag and reestablish flow of flowable material, all with vacuum being applied continuously to the system.

Figure 2:
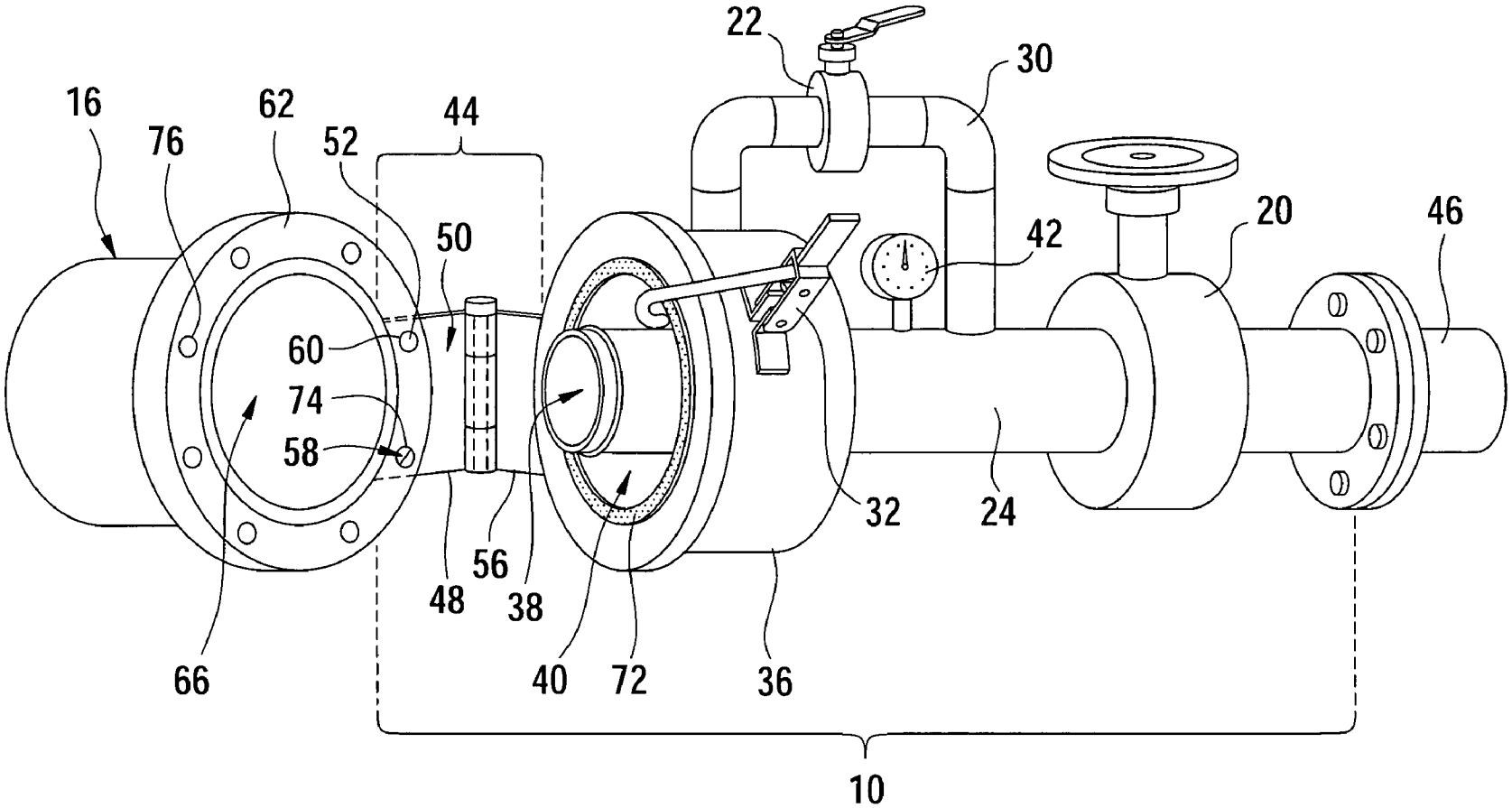
FIG. 2 is an embodiment of the manifold apparatus of FIG. 1 in perspective view.

As shown in FIG. 2, manifold apparatus 10 is detachably attached to second object 16 at a second object portal 66 which comprises a flange member 62. Flange member 62 defines a plurality of flange apertures 60,74,76. Manifold apparatus 10 is shown to be attached to a flowable material conduit 46 by conventional flange attachment. Flowable material conduit 46 provides fluid communication and accessibility from a source of flowable material, through manifold apparatus 10, and into second object portal 66, as best viewed in FIG. 1B. A hinging structure 44 is shown to provide the detachable attachment of manifold apparatus 10 to first object portal 64.

In a preferred embodiment of the invention, hinging structure 44 comprises a first plate member 48 which forms a surface 50 and a second plate member 56. Surface 50 of first plate member 48 forms a projecting pin 52 and also defines a plate aperture 54 (best seen in FIG. 3). Second plate member 56 is rotationally joined to first plate member 48 and also attached to housing 36 by a conventional method such as welding. Projecting pin 52 is sized and configured to be received by a first flange aperture 60. Hinging structure 44 also comprises a bolt 58 which is sized and configured to be received by second flange aperture 74 and by plate aperture 54 (best seen in FIG. 3). When first flange aperture 60 receives projecting pin 52 and second flange aperture 74 receives bolt 58, first plate member 48 and second plate member 56 may rotate into substantially flush position relative to one another. The rotation of the plate members acts to bring flange member 62 and housing 36 into close proximity so that a substantially sealing relationship between the two can be effected.

Figure 3:
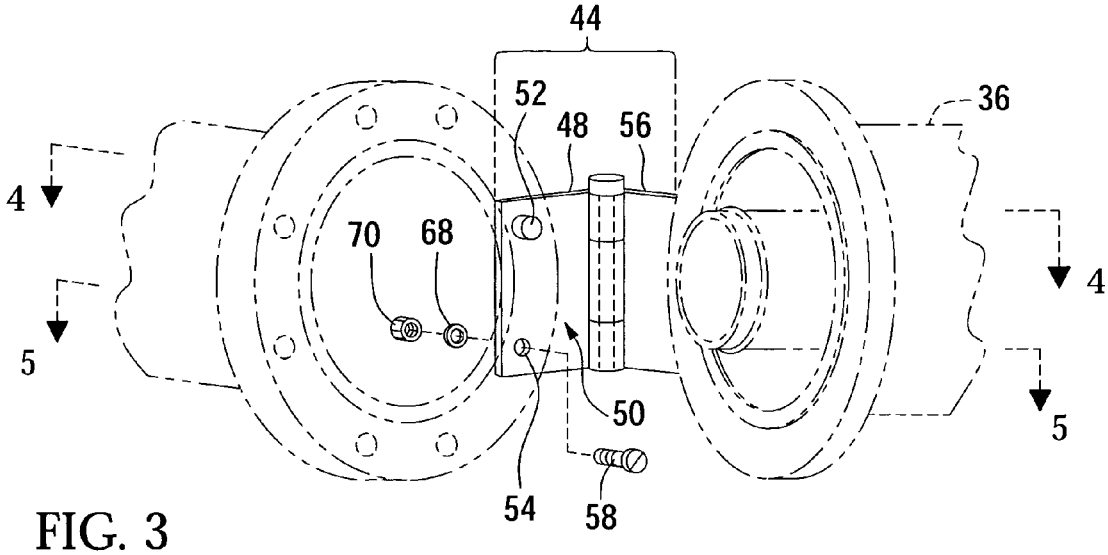
FIG. 3 is a perspective view of an embodiment of the invention showing a hinging structure.
Figure 4:
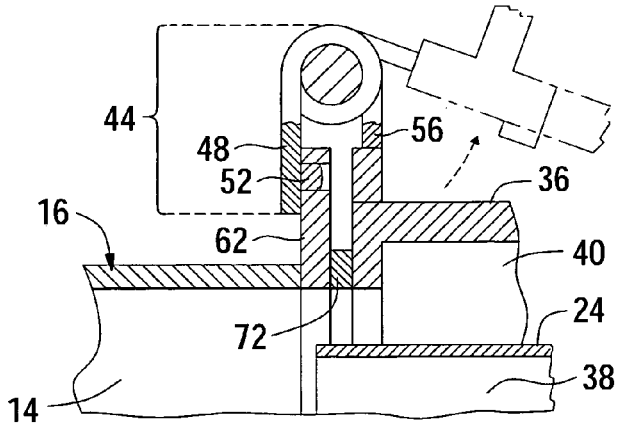
FIG. 4 is a top cross-sectional view of the hinging structure of FIG. 3.
Figure 5:
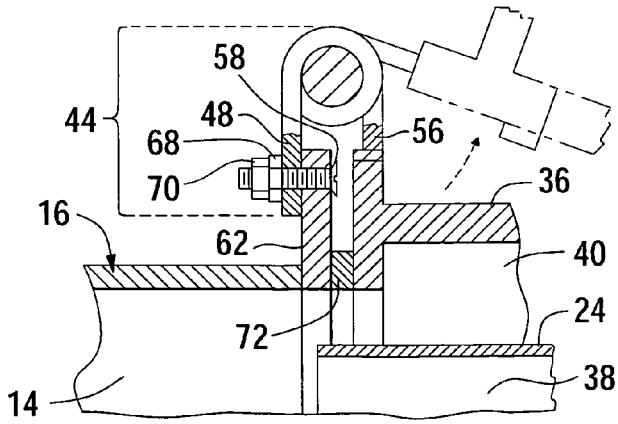
FIG. 5 is a bottom cross-sectional view of the hinging structure of FIG. 3.

As seen in FIGS. 3, 4 and 5, a gasket 72 aids in establishing the seal as does latch mechanism 32 which is sized and configured to attach to another flange aperture 76. Attachment of second plate member 56 to housing 36 is shown to be accomplished by welding. Bolt 58 is secured with washer 68 and nut 70.

Figure 6:
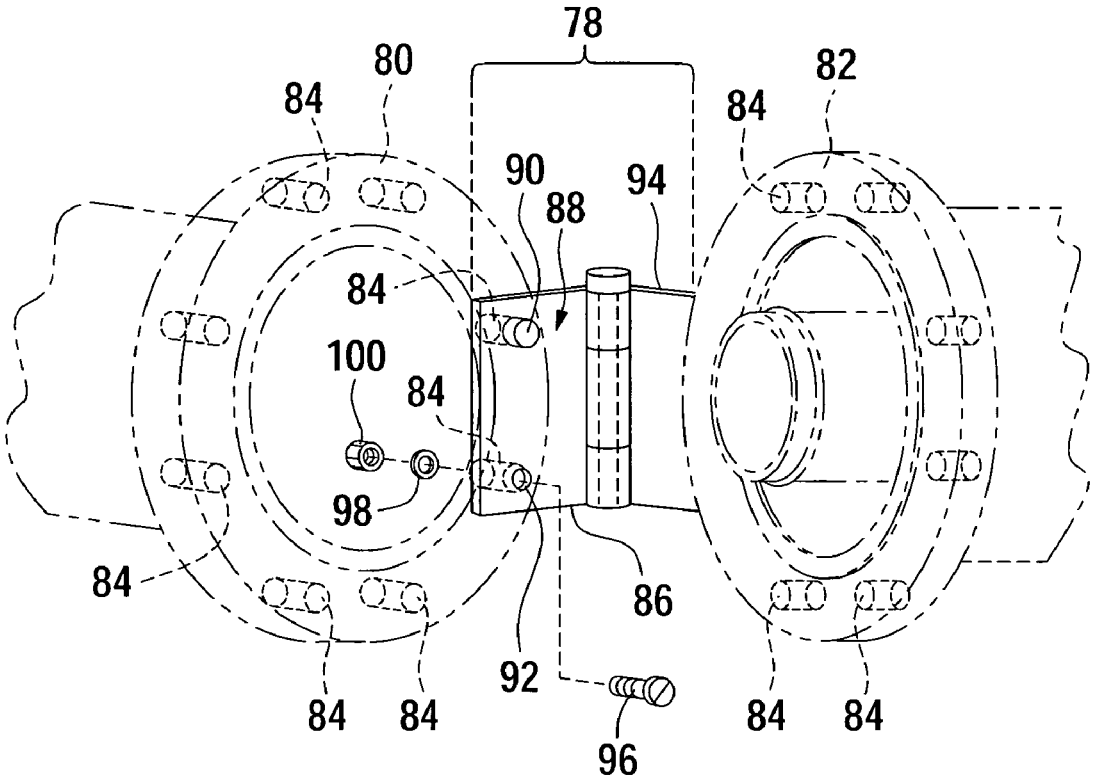
FIG. 6 is a perspective view of an embodiment of the invention.

Another embodiment of the invention, as illustrated in FIG. 6, provides an assembly 78 for joining a first flange member 80 and an second flange member 82 wherein first flange member 80 defines two or more flange apertures 84,84. Assembly 78 comprises a first plate member 86, which form a first plate member surface 88. First plate member surface 88 forms at least one projecting pin 90. Projecting pin 90 is sized and configured to be received by at least one of two or more flange apertures 84. First plate member surface 88 also defines at least one plate aperture 92. A second plate member 94 is rotationally joined to first plate member 86 and is attached to second flange member 82. Assembly 78 further comprises at least one bolt 96, sized and configured to be received by plate aperture 92 and by at least one flange aperture 84. When two of the two or more flange apertures 84,84 are aligned with projecting pin 90 and with plate aperture 92, when a first of the two or more flange apertures 84,84 receives projecting pin 90, and when a second of the two or more flange apertures 84,84 and plate aperture 92 receive bolt 96 there through, first plate member 86 and first flange member 80 are joined. Washer 98 and nut 100 serve to secure bolt 96. This allows first flange member 80 and second flange member 82 to rotate into substantially flush position relative to each other. Second plate member 94 is shown as being attached to second flange member 82 by welding.

Another preferred embodiment of the invention provides an assembly similar to the embodiment of the invention as depicted as in FIG. 6 but wherein the second plate member forms a second surface. The second plate member surface defines at least two plate apertures, and the second flange member defines two or more flange apertures. The assembly further comprises at least two bolts sized and configured to be received by at least two of the flange apertures of the second flange member and by the plate apertures. This embodiment of the invention provides that the second plate member is attached to the second flange member by aligning the plate apertures of the second plate with the flange apertures of the second flange and inserting the at least two bolts there through.

The vacuum pump employed to produce the necessary vacuum within the vacuum container may vary and could be virtually any pump capable of generating a vacuum. Commonly employed pumps will include centrifugal vacuum pumps, jet pumps, or the like. However, in preferred embodiments, the vacuum pump is one which is capable of creating a vacuum in a substantially sealed volume without any meaningful air intake into the sealed volume. In one preferred embodiment, the pump is a jet pump substantially like that which is taught in commonly owned patents, U.S. Pat. No. 6,322,327 and U.S. Pat. No. 6,450,775. The pump described in the latter patent, commonly known as the Pearce Closed Loop Vacuum System marketed by Pearce Pump Supply, Inc. of Prairieville, La., is particularly preferred for its ability to achieve a high vacuum and to maintain the vacuum under dry or wet conditions, its ease of maintenance as compared with conventional mechanical pumps and its ability to re-circulate the motive fluid which drives the jet pump.

The vacuum container employed in the embodiments of this invention should be sufficiently rigid to withstand the vacuum necessary to facilitate use of the system, all inlets, outlets and ports defined by the walls of the container should be equipped with fittings and seals which enable a vacuum to be maintained within the container. Conventional containers known as vacuum roll-off containers, for example, can be modified for use as the vacuum container in accordance with this invention when commercial operations call for transportation, disposal or storage of large volumes of material.

The level of vacuum to be maintained within the container will vary depending upon the ambient pressure and temperature conditions, the nature of the material to be moved, the size of the vacuum container and related equipment and the physical characteristics of the bulk bag employed. As a non-limiting example, when employing a vacuum roll-off container of the size of about 25 cubic yards (22.86 cubic meters) and a bulk bag of the size of about 25 cubic yards (22.86 cubic meters) made from coated polypropylene sheet material, the vacuum provided to move about 20 cubic yards of slurry material into the bag, the material having an average particle size of about 3 inches or less and a weight of about 2000 pounds per cubic yard, within a period of time of about 20 minutes at room temperature and pressure, is in the range of about 10 to about 15 inches Hg.

As used herein the phrase "put into fluid communication with" signifies that some means of connecting the designated elements is employed, such as tube, lines, conduit, pipes, manifolds or the like, as long as fluid can pass between the designated elements.

The bulk bags employed in the systems of this invention will typically be sized in a fashion consistent with the size of the rigid container employed, but are preferably somewhat smaller than the container to avoid having excess bag material within the container which might foul the vacuum operation. Commercial vacuum roll-off containers suitable for use in the systems of this invention are typically in the range of about 25 to about 30 cubic yards (about 22.86 to about 27.43 cubic meters) in volume size. For a container of the size of 25 cubic yards, the bag will typically be in the range of about 3000 to about 5050 gallons, depending on the application. The material used to fabricate the bulk bags will depend upon the application. For applications requiring a substantially air and liquid impervious material, non-limiting examples of suitable material include coated woven polypropylene or string reinforced polyethylene film material. Such material is sold under the brand and product indentifier "string reinforced poly films" by Manufactured Plastics and Distribution Inc. Of Palmer Lake, Colo. In all cases, the material thickness may vary depending upon the strength requirements for the material to be placed in the bag.

Each and every patent, publication, or commonly-owned patent application referred to in any portion of this specification is incorporated in toto into this disclosure by reference, as if fully set forth herein.

This invention is susceptible to considerable variation in its practice. Therefore the foregoing description is not intended to limit, and should not be construed as limiting, the invention to the particular exemplifications presented herein above. Rather, what is intended to be covered is as set forth in the ensuing claims and the equivalents thereof permitted as a matter of law.

We claim:

1. A system comprising:

(A) a first object defining a first volume;

(B) a second object defining a second volume, which second object contains the first object; and (C) a manifold apparatus comprising:

(I) a first flow controller;

(II) a second flow controller;

(III) a primary fluid conduit through which a flow of flowable material may be controlled by the first flow controller, the primary fluid conduit being in fluid communication with the first volume and with a source of flowable material;

(IV) a secondary fluid conduit through which a flow of a gas may be controlled by the second flow controller wherein the secondary fluid conduit is in fluid communication with the primary fluid conduit; and (V) a housing surrounding at least a portion of the primary conduit, which housing defines a housing volume, which housing volume is in fluid communication with the second volume and with the secondary fluid conduit;

whereby the flowable material may flow from the source of flowable material to the first volume through the primary fluid conduit upon sufficient application of a first motive force when the first flow controller is open and the second flow controller is closed, and whereby the gas may be transported from the first volume to the second volume by passing through the primary fluid conduit, the secondary fluid conduit and the housing volume, upon sufficient application of a second motive force when the first flow controller is closed and the second flow controller is open.

2. A system according to claim 1 wherein both the first motive force and the second motive force result from a vacuum created in the second volume.

3. A system according to claim 2 wherein the vacuum in the second volume is provided by use of a jet pump.

4. A system according to claim 1 wherein the flowable material comprises (1) at least one fluid, (2) a slurry of at least one liquid and at least one solid, (3) at least one particulate solid capable of fluid-like flow, or (4) any two or more of the foregoing.

5. A system according to claim 1 wherein the manifold apparatus is detachably attached to the second object by a hinging structure and to a flowable material conduit for transporting the flowable material from the source of flowable material.

6. A system according to claim 5 wherein the hinging structure comprises:

(a) a first plate member which forms a surface which first plate member surface forms at least one projecting pin and defines at least one plate aperture;

(b) a second plate member which is rotationally joined to the first plate member and which second plate member is attached to the housing; and (c) at least one bolt;

wherein the projecting pin is sized and configured to be received by a first flange aperture of two or more flange apertures defined by a flange member of the second object, and wherein the bolt is sized and configured to be received by the plate aperture and by a second flange aperture, such that when the first and second flange apertures receive the projecting pin and the bolt, the first plate member and the second plate member may rotate into substantially flush position relative to one another.

7. A system according to claim 1 wherein the second object is a vacuum container and the first object is a bag formed from a fluid impermeable substance.

8. A method for loading a flowable material into a first object, which first object is contained by a second object, which method comprises:

(A) attaching a manifold apparatus to a first object portal and to a second object portal, which apparatus comprises:

(I) a primary fluid conduit and a first flow controller sized and configured to control a flow of the flowable material through the primary fluid conduit and which primary fluid conduit is in fluid communication with a first volume defined by the first object;

(II) a secondary fluid conduit and a second flow controller sized and configured to control a flow of a gas from the first volume through the secondary fluid conduit, wherein the secondary fluid conduit is in fluid communication with the primary fluid conduit; and (III) a housing surrounding at least a portion of the primary fluid conduit, which housing is in fluid communication with the secondary fluid conduit and with a second volume defined by the second object which second volume is discrete from the first volume;

(B) placing the primary fluid conduit into fluid communication with a source of flowable material;

(C) opening the first flow controller and closing the second flow controller so that the flowable material can move from the source of flowable material into the first volume;

(D) creating a vacuum in the second volume, such that pressure of the second volume is less than pressure of the first volume thereby causing the flowable material to move from the source of flowable material, through the primary fluid conduit and into the first volume;

(E) removing substantially all of the gas from the first volume by (i) closing the first flow controller thereby interrupting movement of the flowable material into the primary fluid conduit, (ii) opening the second flow controller to place the first volume in fluid communication with the secondary fluid conduit, with the housing, and with the second volume thereby causing the gas to move from the first volume to the second volume, (iii) closing the second flow controller, and optionally (iv) opening the first flow controller to thereby re-establish movement the flowable material into the first volume; and (F) optionally, repeating (E) one or more times.

9. A method according to claim 8 wherein the flowable material comprises (1) at least one fluid, (2) a slurry of at least one liquid and at least one solid, (3) at least one particulate solid capable of fluid-like flow, or (4) any two or more of the foregoing.

10. A method according to claim 8 wherein the first object is a bag formed from a fluid impermeable substance.

11. A method according to claim 8 wherein the second object is a rigid container.

12. A method according to claim 11 wherein the rigid container is a vacuum container.

13. A method according to claim 8 wherein the vacuum is created by use of a jet pump.

14. A method according to claim 8 further comprising detachably attaching the manifold apparatus to the second object portal by use of a hinging structure.

15. A method according to claim 14 wherein the hinging structure comprises:

(a) a first plate member which forms a surface, which first plate member surface forms at least one projecting pin and defines at least one plate aperture;

(b) a second plate member which is rotationally joined to the first plate member and which second plate member is attached to the housing; and (c) at least one bolt;

wherein the projecting pin is sized and configured to be received by a first flange aperture of two or more flange apertures defined by a flange member of the second object portal, and wherein the bolt is sized and configured to be received by the plate aperture and by a second flange aperture, such that when the first flange aperture receives the projecting pin and the second flange aperture receives the bolt, the first plate member and the second plate member may rotate into substantially flush position relative to one another.

16. A method according to claim 15 wherein the first object is a bag formed from a fluid impermeable substance, the second object is a vacuum container, and wherein the vacuum is created by use of a jet pump.

* * * * *